US008622395B2

(12) United States Patent
Bouchard

(10) Patent No.: US 8,622,395 B2
(45) Date of Patent: Jan. 7, 2014

(54) GAMES USING DARTS OR ARROWS

(76) Inventor: Jean Bouchard, Lavaltrie (CA)

( * ) Notice: Subject to any disclaimer, the term of this patent is extended or adjusted under 35 U.S.C. 154(b) by 274 days.

(21) Appl. No.: 12/958,815

(22) Filed: Dec. 2, 2010

(65) Prior Publication Data

US 2011/0127724 A1 Jun. 2, 2011

Related U.S. Application Data

(60) Provisional application No. 61/265,957, filed on Dec. 2, 2009.

(51) Int. Cl.
*F41J 3/02* (2006.01)
*B65D 85/00* (2006.01)

(52) U.S. Cl.
USPC ..... 273/408; 206/315.1; 206/579

(58) Field of Classification Search
USPC ..... 206/579, 315.1; 273/403, 404, 407, 408
See application file for complete search history.

(56) References Cited

U.S. PATENT DOCUMENTS

| | | | | | |
|---|---|---|---|---|---|
| 3,151,741 | A | * | 10/1964 | Haecker | 206/579 |
| 3,300,216 | A | * | 1/1967 | Haecker | 273/403 |
| 3,309,091 | A | * | 3/1967 | Haecker | 273/408 |
| 3,501,149 | A | * | 3/1970 | Meyer | 273/407 |
| 3,891,214 | A | * | 6/1975 | Scullin | 273/408 |
| 4,105,119 | A | * | 8/1978 | Cowan | 206/579 |
| 4,625,974 | A | * | 12/1986 | Andrews | 273/407 |
| 5,054,792 | A | * | 10/1991 | Danielson | 273/408 |
| D343,575 | S | * | 1/1994 | Edelson | D9/415 |
| 6,045,132 | A | * | 4/2000 | Giegerich | 273/408 |
| 2007/0158912 | A1 | * | 7/2007 | Hartwig et al. | 273/348 |

* cited by examiner

*Primary Examiner* — Mark Graham
(74) *Attorney, Agent, or Firm* — Benoît & Côté Inc.

(57) ABSTRACT

The present document describes games using darts or arrows. More particularly, this description relates to targets and accessories used for new games.

8 Claims, 9 Drawing Sheets

GAMES USING DARTS OR ARROWS

CROSS REFERENCE TO RELATED APPLICATION

This application claims priority from U.S. Provisional Application Ser. No. 61/265,957, filed Dec. 2, 2009, which is incorporated herein by reference in its entirety.

TECHNICAL FIELD

This description relates to the field of games using darts or arrows. More particularly, this description relates to targets and accessories used for new games.

SUMMARY

According to an embodiment, there is provided a target for darts or arrows comprising one of:

a) an area divided into a number of separate spaces equal to the number of cards of two complete decks of given playing cards;

b) an area divided into a number of separate spaces equal to the number of cards of a subset of two decks of given playing cards;

c) an area divided into 104 separate spaces, each space representing one card of two decks of 52 regular playing cards;

d) an area representing a pool table, the area comprising 16 spaces, each space representing one ball of a 16-ball set of American-style pool;

e) both i. a first area divided into 52 separate spaces, each space representing one card of a deck of 52 regular playing cards; and ii. a second area divided into 9 separate spaces representing a tic-tac-toe game;

f) an area divided into 9 separate spaces representing a tic-tac-toe game; and g) an area divided into 75 separate spaces, each space representing one ball of a 75-ball set of bingo balls.

According to an embodiment, there is provided a target for darts or arrows comprising an area divided into 104 separate spaces, each space representing one card of two decks of 52 regular playing cards.

According to an embodiment, there is provided a target for darts or arrows comprising an area representing a pool table, the area comprising 16 spaces, each space representing one ball of a 16-ball set of American-style pool.

According to an embodiment, there is provided a case for holding darts, the case comprising: a lower portion comprising a curved side adapted to fit above a dart board; an upper portion mounted on the upper portion on which are located holes for holding the darts, the upper portion further comprising a scoreboard area.

According to an embodiment, there is provided a target for darts or arrows comprising: a first area divided into 52 separate spaces, each space representing one card of a deck of 52 regular playing cards; and a second area divided into 9 separate spaces representing a tic-tac-toe game.

According to an embodiment, there is provided a target for darts or arrows comprising an area divided into 9 separate spaces representing a tic-tac-toe game.

According to an embodiment, there is provided a target for darts or arrows comprising area divided into 75 separate spaces, each space representing one ball of a 75-ball set of bingo balls.

According to an embodiment, there is provided an actuator for rotating a target comprising: a frame comprising attachment holes for fixing the frame to a substantially vertical surface; a motor mounted to the frame; an interface between the motor and the target to impart a rotating motion to the target.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
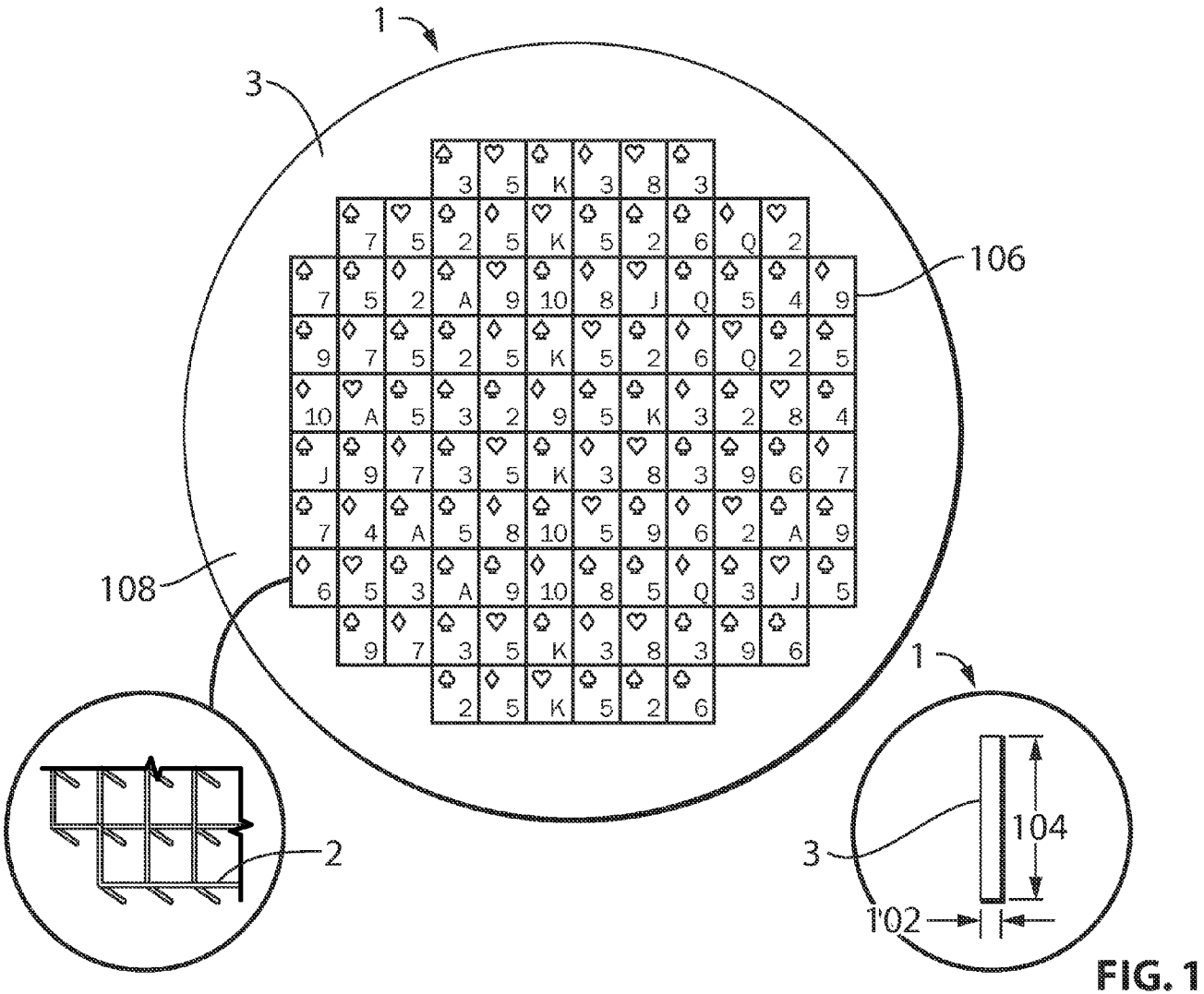
FIG. 1 is a schematic front view of a target for card games according to an embodiment.

Referring now to the drawings, and more particularly to FIG. 1, there is shown a target 1 for playing cards with projectiles like a dart or an arrow. The target 1 is disk-shaped as is usual for a target for such projectiles. According to an embodiment, the target is a modified dart board or a specially-made board having the same size and materials as a regular dart board. In a right lower circle there is shown a side view of the target 1. At left side is an operating face 3 for receiving the projectiles. The operating face 3 is made of a material like sisal fibers and adapted for receiving the projectiles. A thickness 102 of the target 1 is such that the target 1 is rigid enough so that the projectile enters the operating face 3 sufficiently to be held in place without passing through the target 1. A height represents the diameter 104 of the target 1. Optionally, a target can have two operating faces, a front one for playing a game and a back one for playing another game.

Two sets of 52 cards each are printed on the operating face 3 of the target 1. Each set comprises cards Ace, 2, 3, 4, 5, 6, 7, 8, 9, 10, Jack, Queen, King in each of the four suits (Spades, Hearts, Diamonds and Clubs). Card images 106 are contiguously packed on the operating face 3 forming a pack, not numbered. When a projectile reaches the target 1 in the pack, the projectile reaches inevitably at least one card image 106. Each card image 106 has the same dimensions as the others. Optionally, card image dimensions and placement vary depending on the value given to each associated card. The number of card images 106 is chosen in order to fill most of the area of the operating face 3 and to do that each card image 106 has a size which offers to a player a likelihood of not reaching a chosen card image 106 with a projectile.

This target 1 allows playing of Poker, Black-Jack or other card games according to new rules. These new rules can be based on regular rules except that instead of drawing a card at random from a set, the player throws a projectile toward the operating face and gets, virtually, the card in which the projectile is driven.

In a left lower circle there is shown a portion of a grid 2. The grid 2 surrounds each card image 106 so that when a projectile reach a border area between two card images 106 or between the pack and a rest 108 of the target 1, the projectile is clearly deflected toward only one card image 106 or outside the pack. The grid 2 is made of a triangular shaped wire.

Although not shown the Figures are meant to include other types of given playing cards such as, but not limited to, tarot playing cards or other types of games such as dominoes.

Figure 2:
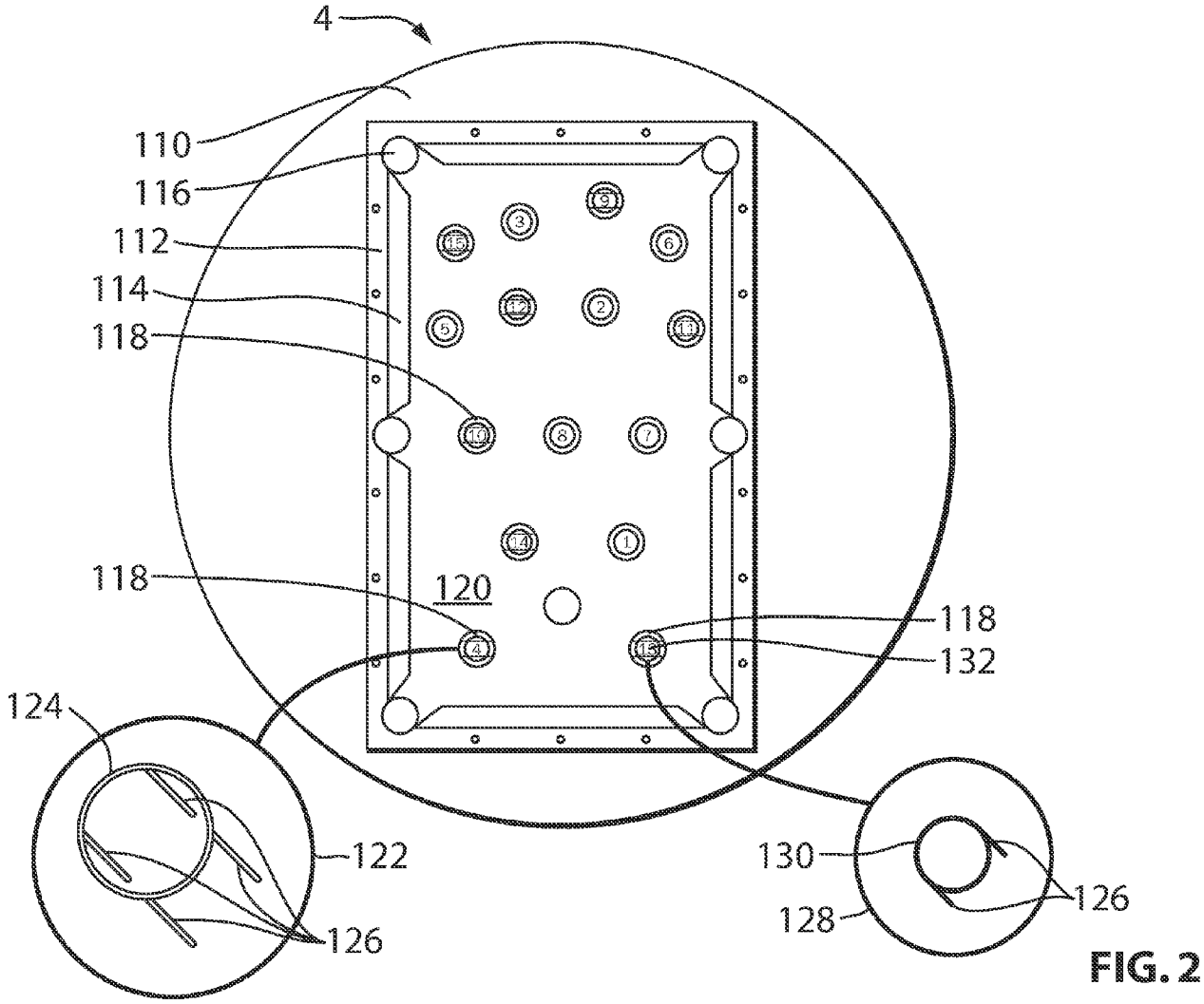
FIG. 2 is a schematic front view of a target for billiard, pool or snooker game according to another embodiment.

Referring to FIG. 2, there is shown an operating face 110 of a disk-shaped target 4 according to another embodiment. A realistic billiard table is printed on the operating face 110 comprising rails 112, cushions 114, pockets 116 and balls 118 on the bed 120. In a left lower circle 122 there is shown a wire circle 124 with spikes 126. The spikes 126 are to be driven in the operating face 110. The wire circle 124 is to delimit the balls 118 and to clearly deflect a projectile inside the ball 118 or outside the ball 118. To be most effective, the wire circle 124 is made of a triangular shaped wire. In a mid lower circle 128 there is shown a central wire circle 130 with spikes 126. The spikes 126 are to be driven in the operating face 110. The central wire circle 130 delimits a central area 132 in the ball 118. Each of the balls 118 is surrounded by a wire circle 124 and comprises a central wire circle 130 inside for delimiting a central area 132.

This target 4 allows playing of billiard, pool or snooker according to new rules. These new rules can be based on regular rules except that instead of cuing a ball to a pocket, the player throws a projectile toward the operating face and puts virtually the ball which has been reached by the projectile in a pocket. Theses rules use the balls 118 and the central area 132 for the scoring, depending on the rating of each player or depending on periods of the games.

Figure 3:
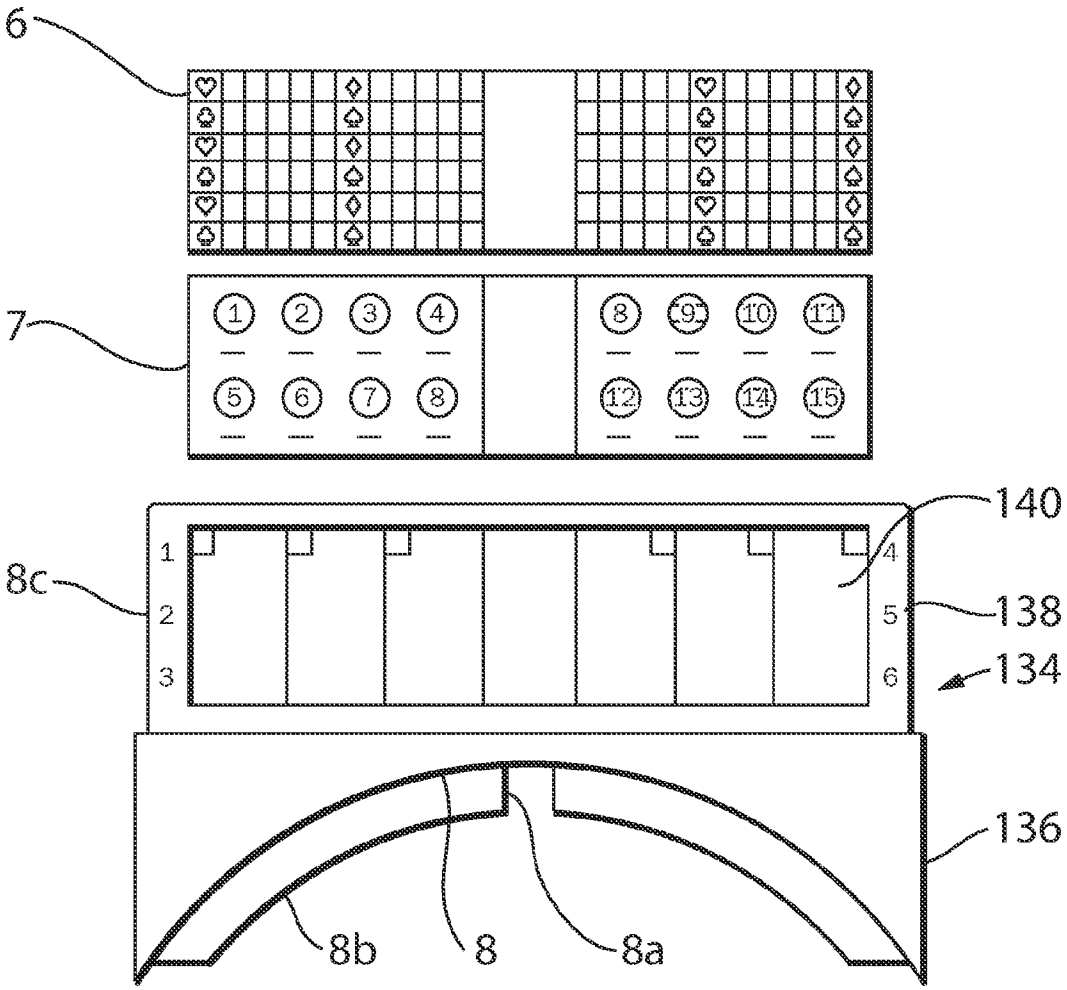
FIG. 3 is an schematic view of a case and its options to add on a target according to another embodiment.
Figure 6:
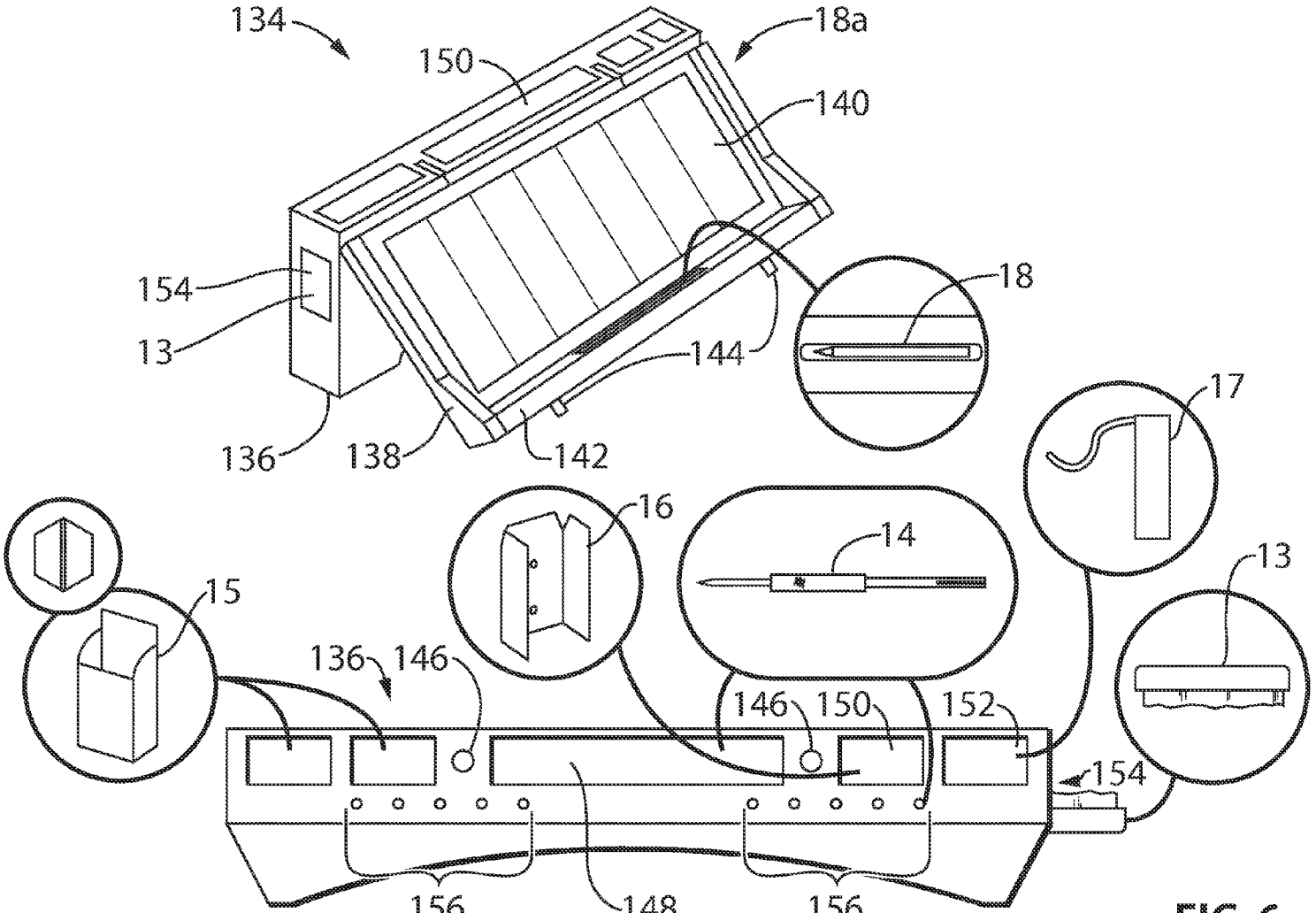
FIG. 6 gathers various views of the case of FIG. 3 and its accessories.

Concurrently referring to FIG. 3 and FIG. 6, there are shown a case 134 and its options and its accessories. The case 134 comprises a lower portion 136 and an upper portion 138. The lower portion 136 has a curved form 8B for resting on a top of a disk shaped target. A notch 8A is for receiving a blocker 16, as seen on FIG. 6, for fixing the case 134 to the target. The upper portion 138 comprises a removable scoreboard 140. The scoreboard 140 can slide through a slot 8C on a side of the upper portion 138. The scoreboard 140 is for keeping score in a regular darts game and can be replaced by a billiard scoreboard 7 or a Poker scoreboard 6. Each one of the two faces of scoreboards can be used for two different games. On FIG. 3, the upper portion 138 is upon the lower portion 136 and can be used for marking a play. The case 134 being settled or mounted on a target.

On an upper drawing on FIG. 6, there is shown the case 134 which has been dismounted from a target and which is put on table beside the target. The upper portion 138 is detached from the lower portion 136, put on the table and leaned to the lower portion 136 by means of hooks 17. That allows marking a game beside the target without disturbing the game. On a base 142 of the upper portion 138, a groove 18 is present for receiving a marker or an adapted pen to write on the scoreboard 140. Optionally, the upper portion can be coupled to the lower portion by a hinge or other means allowing setting and using the scoreboard 140 on a table or the like. Centering studs 144 extend from the bottom of the base 142 for being engaged in centering bores 146 located on the top of the lower portion 136 to center and engage the upper portion 134 with respect to the lower portion 136.

On a lower part of FIG. 6, there is shown a perspective from the top of the lower portion 136 of the case 134. The lower portion 136 comprises a projectile container 148 for containing projectiles as a dart 14. When the upper portion 138 is put on the lower portion 136, the base 142 closes an opening 150 of the projectile container 148 closing the projectiles away from the sight of children especially. The lower portion 136 further comprises containers 15 for storing wings, a container 150 for storing the blocker 16, a container 152 for storing the hooks 17 and a container 154 for storing an eraser 13. In a closed position as shown on FIG. 3, every accessory can be stored in the case 134. In the closed position, darts can be driven in holes 156 as well, for temporarily putting them in order, as shown on FIG. 3.

Figure 4:
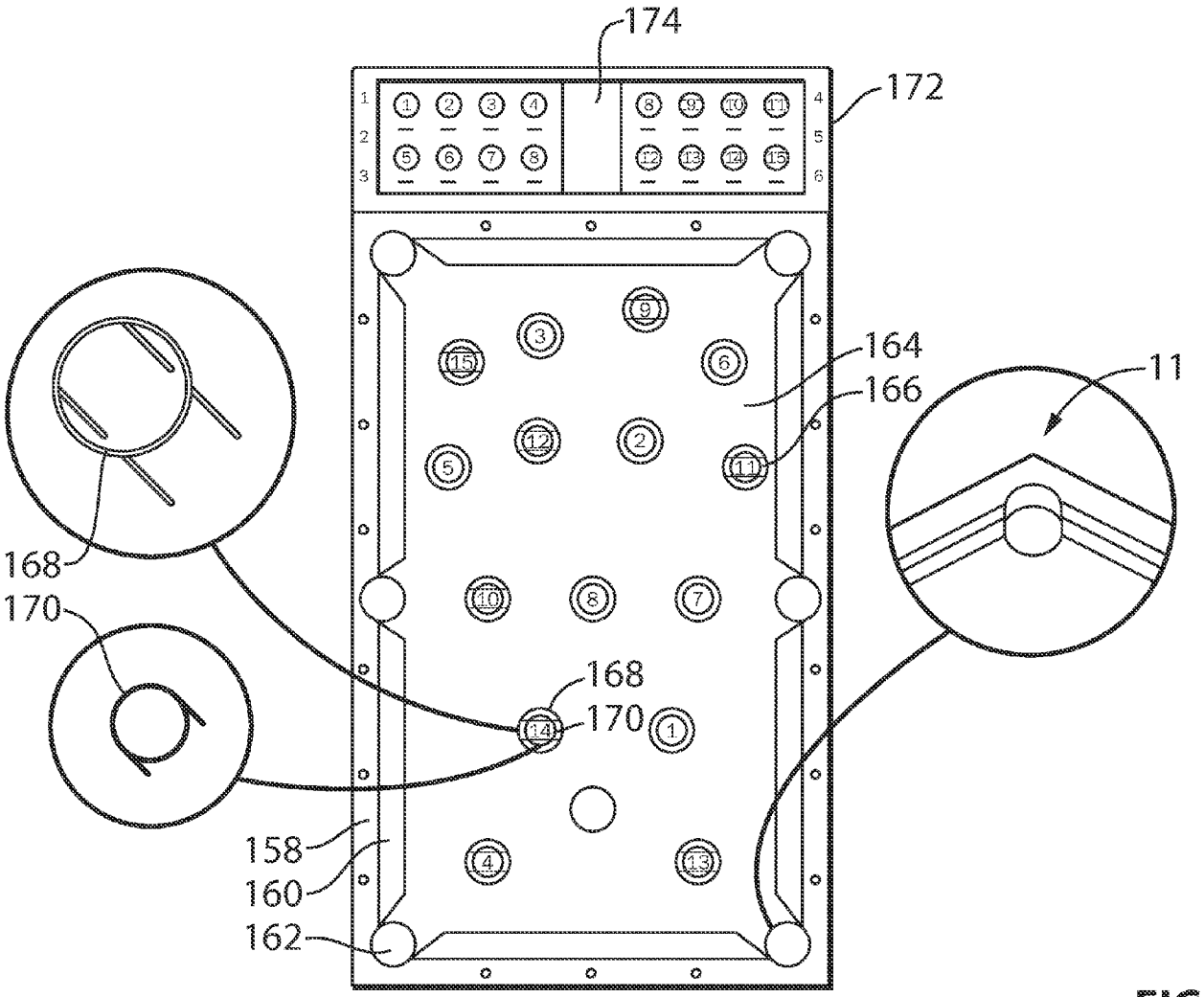
FIG. 4 is mainly a schematic view of a target for billiard, pool or snooker game according to another embodiment.

Referring to FIG. 4, there is shown a target 9 according to another embodiment. The target 9 is rectangular shaped as a real billiard table. The target 9 comprises real rails 158, real rubber cushions 160 and real pocket 162 shaped in tree dimensions. The target 9 further comprises an operating face 164 with balls 166 printed thereon. Like the target 4, the target 9 comprises wire circles 168 and central wire circles 170 driven in the operating face 164 for delimiting balls and central areas of balls. This target 9 allows playing billiard, pool or snooker according to new rules. A case 172 comprising a scoreboard 174 is mounted upon the target 9.

Figure 5:
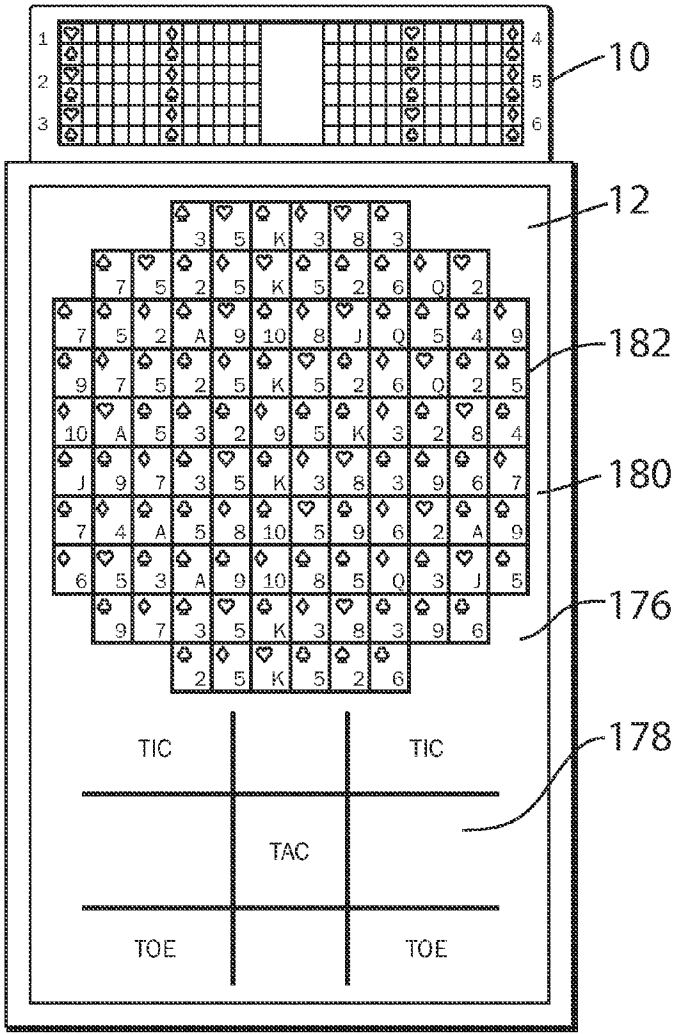
FIG. 5 is a schematic front view of a target for combined game of cards and Tic-Tac-Toe according to another embodiment.

Referring to FIG. 5, there is shown a target 12 with a case 10 mounted thereon. The target 12 is rectangular shaped and comprises an operating face 176. The operating face 176 comprises a lower part 178 and an upper part 180. On the upper part 180, card images 182 are printed thereon and are disposed likely the card images 106 of the target 1 shown on FIG. 1. On the lower part 178, a tic-tac-toe table is printed thereon. This target 12 allows playing Poker, Black-Jack or other card games, tic-tac-toe and combined games according to new rules.

Figure 7:
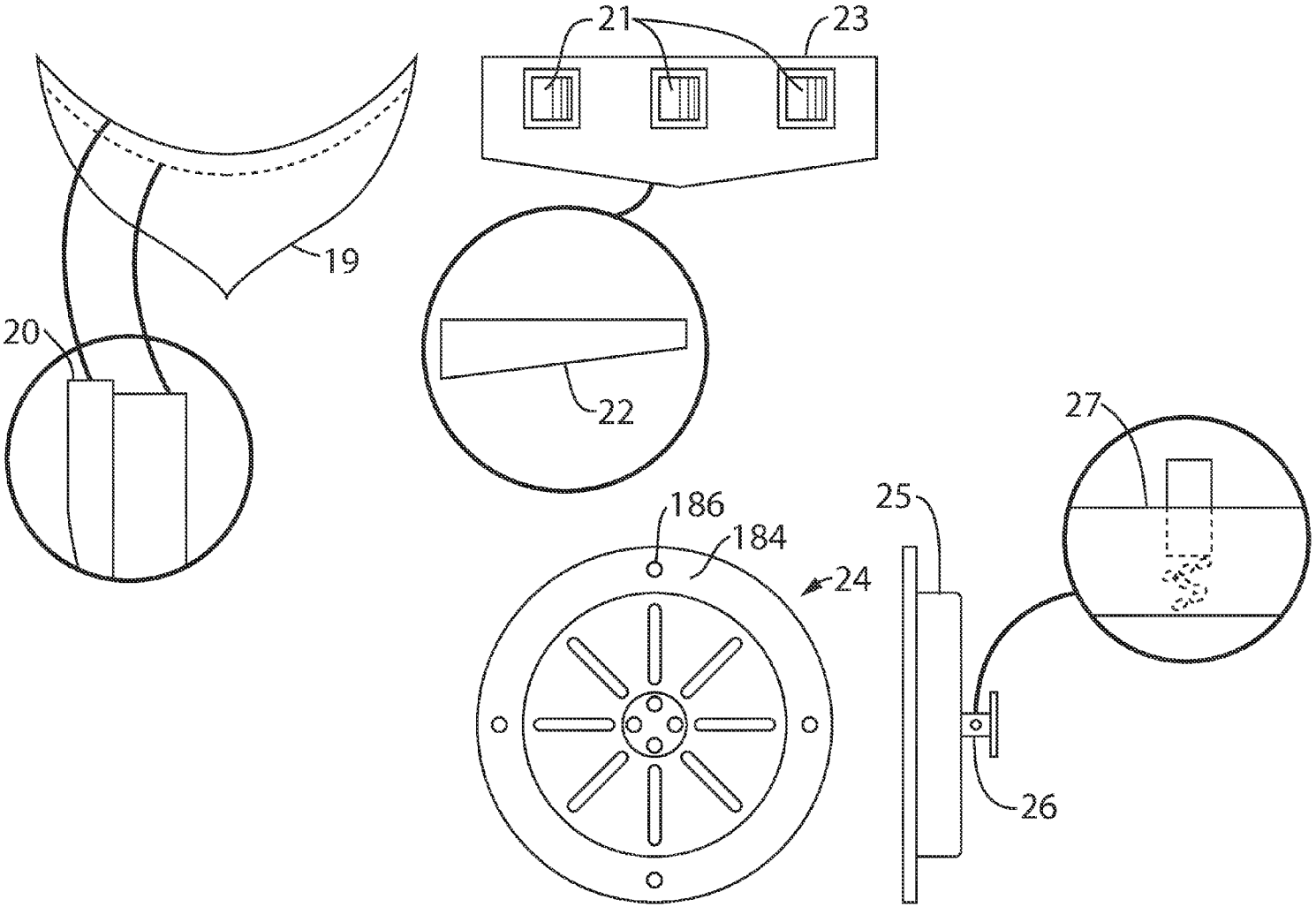
FIG. 7 gathers various views of two different systems for rotating a target according to another embodiment.

Referring to the upper part of FIG. 7, there are shown different views relating to an actuator 19. The actuator 19 is an accessory to be installed under a disk-shaped target for the purpose of rotating the target around an axis normal to the operating face and crossing the center of the target. The target is driven by three rubber rolls 21 contacting the periphery of the target. The rollers 21 are driven in rotation by an electric motor comprised inside the actuator 19.

Referring to the lower part of FIG. 7, there is shown different views relating to an actuator 24 according to another embodiment. The actuator 24 comprises a frame 184 with holes 186 for fixing to a wall. An electric motor, not shown, installed into a body 25 drives a removable rotating plate 26 extending outside the body 25. Rotating plate 26 can be installed and removed by a connector 27. A target can be fixed to the rotating plate 26. Such rotating targets offer a lot of possibilities of entertainment with projectiles and different types of target as previously described.

Figure 8:
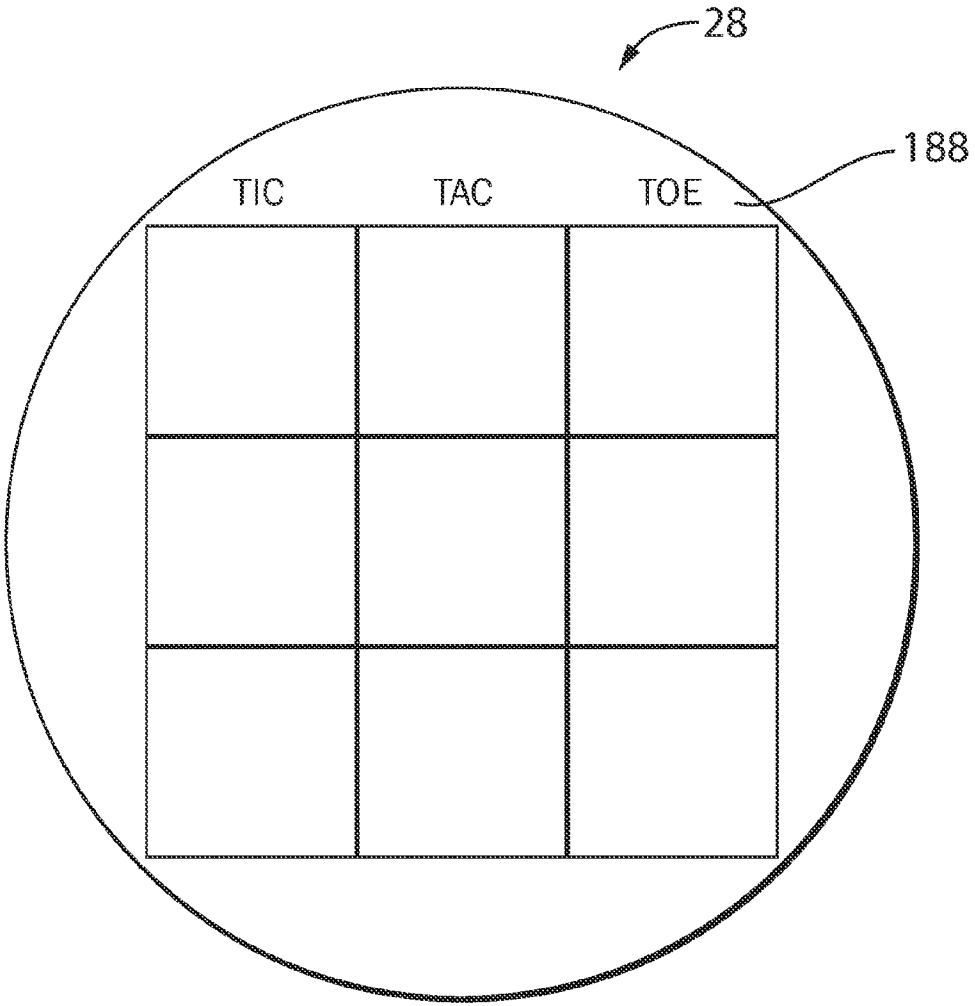
FIG. 8 is a front view of a target for a Tic-Tac-Toe game according to another embodiment.

Referring to FIG. 8, there is shown a disk-shaped target 28 with an operating face on which a tic-tac-toe table is printed.

Figure 9:
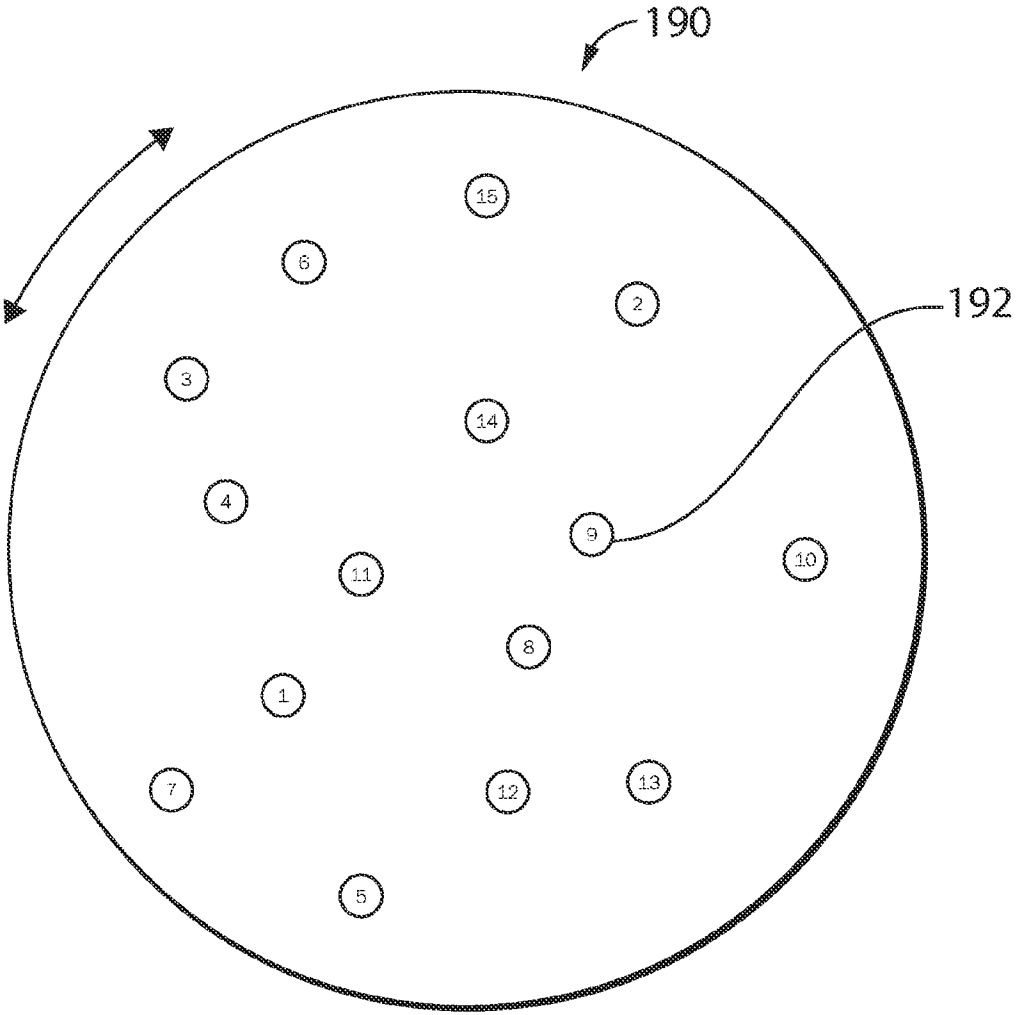
FIG. 9 is a schematic front view of a target for a bingo game according to another embodiment.

Referring to FIG. 9, there is shown a disk-shaped target 190 with an operating face on which 75 numbered balls 192 of Bingo game are printed. The target 190 is mounted on an actuator (motor) such as actuator 24 of FIG. 7 for alternatively rotating the target 190 in clockwise and anticlockwise directions. Such a target 190 simulates a real bingo sphere. A player throws a projectile on the target, if the projectile reaches a ball 192, the number printed on the reached ball 192 is given as it has been obtained by a real bingo sphere.

It is understood that a person skilled in the art could envision a target made of wood, cardboard, paper, cellulose or other plant fiber, or product of chemical synthesis able to receive a dart or an arrow having a spike ahead. The target could also be adapted for receiving other types of dart or arrow having a magnet, hook and loop system, etc. Also the target could be an electronic picture produced by a system able to receive a virtual projectile and able to figure out the position of the impact of the projectile on the target. Such system could be operated on Wii, Xbox (Kinect), PSP, PlayStation, iPod, iPhone, regular desktop or laptop.

While preferred embodiments have been described above and illustrated in the accompanying drawings, it will be evident to those skilled in the art that modifications may be made therein without departing from the essence of this disclosure. Such modifications are considered as possible variants comprised in the scope of the disclosure.

The invention claimed is:

1. A case for holding darts, the case comprising:

a lower portion defining an upper surface and a lower curved surface having a circumference of less than a semi-circular shape adapted to fit above a dart board having a circumference, the lower curved surface having a perimeter for surrounding less than a half of the circumference of the dart board;

an upper portion located above the lower portion and defining a lower surface, the lower surface of the upper portion being hinged with the upper surface of the lower portion, wherein holes are located on the upper portion for holding the darts, the upper portion further comprising a scoreboard area.

2. The case of claim 1, further comprising a notch for receiving a blocker for fixing the case to a target.

3. The case of claim 1, wherein the scoreboard area is a removable scoreboard area.

4. The case of claim 1, wherein the upper portion defines a first side and wherein the upper portion further comprises a slot on the first side for slidably receiving the scoreboard.

5. The case of claim 1, wherein the scoreboard defines a first scoreboard side and a second scoreboard side and wherein the first scoreboard side and the second scoreboard side are for keeping score of different games.

6. The case of claim 1, wherein the upper portion further comprises a groove for receiving a marker.

7. The case of claim 1, wherein the lower portion further comprises a container for receiving one of: darts and an eraser.

8. The case of claim 1, wherein the lower surface of the upper portion comprises a mating connector and further wherein the upper surface of the lower portion comprises a corresponding mating connector for releasably connecting with the mating connector of the upper portion.

* * * * *